US007946065B2

(12) United States Patent
Ali et al.

(10) Patent No.: US 7,946,065 B2
(45) Date of Patent: May 24, 2011

(54) CLOSURE MECHANISM FOR AN IDENTIFICATION MEDIUM ADAPTED FOR RECEIVING INDICIA FORMING MATERIAL AND DUAL CLOSURE MEANS

(75) Inventors: Sherif Ali, Los Angeles, CA (US); Kim Canchola, Lancaster, CA (US); Russell Smith, Newhall, CA (US); Tracy Tenpenny, Cedarburg, WI (US); Jeffrey Kerlin, Brookfield, WI (US); Mike Erwin, Mukwonago, WI (US); James Brown, Wind Lake, WI (US)

(73) Assignee: Precision Dynamics Corporation, San Fernando, CA (US)

( * ) Notice: Subject to any disclaimer, the term of this patent is extended or adjusted under 35 U.S.C. 154(b) by 0 days.

(21) Appl. No.: 12/138,219

(22) Filed: Jun. 12, 2008

(65) Prior Publication Data

US 2008/0307685 A1 Dec. 18, 2008

Related U.S. Application Data

(60) Provisional application No. 60/944,033, filed on Jun. 14, 2007, provisional application No. 60/980,858, filed on Oct. 18, 2007, provisional application No. 61/026,994, filed on Feb. 7, 2008.

(51) Int. Cl.
*A44C 5/00* (2006.01)
*G09F 3/14* (2006.01)

(52) U.S. Cl. ..... 40/633; 40/665

(58) Field of Classification Search ..... 40/6, 633, 40/673, 665, 637, 663, 664; 63/3.1, 3.2; D11/3, 5; 24/659, 700
See application file for complete search history.

(56) References Cited

U.S. PATENT DOCUMENTS

| | | | | | |
|---|---|---|---|---|---|
| 76,347 | A | * | 4/1868 | Reeves et al. | 24/659 |
| 1,224,177 | A | * | 5/1917 | Koch | 24/580.1 |
| 3,290,808 | A | * | 12/1966 | Delitz | 40/638 |
| 3,408,703 | A | * | 11/1968 | Brandenburg | 24/614 |
| 4,783,917 | A | * | 11/1988 | Smith et al. | 40/633 |
| 5,601,186 | A | * | 2/1997 | Van Hine et al. | 206/141 |
| 6,888,502 | B2 | | 5/2005 | Beigel et al. | |
| 2005/0108912 | A1 | | 5/2005 | Bekker | |

* cited by examiner

*Primary Examiner* — Joanne Silbermann
(74) *Attorney, Agent, or Firm* — Kelly Lowry & Kelley, LLP

(57) ABSTRACT

A closure mechanism receiving aperture presents a substantially contiguous, uninterrupted planar surface on a flexible medium, primarily for use with identification devices, i.e., wristbands. The aperture does not interrupt the printable area so that printer ink may be printed over the aperture without passing through. The inventive aperture also does not produce waster material or chads which can jam or foul-up a printer. An inventive wristband includes both snap closure and adhesive closure mechanisms that can be used at the same time.

21 Claims, 2 Drawing Sheets

CLOSURE MECHANISM FOR AN IDENTIFICATION MEDIUM ADAPTED FOR RECEIVING INDICIA FORMING MATERIAL AND DUAL CLOSURE MEANS

BACKGROUND OF THE INVENTION

The present invention relates to a closure mechanism for a flexible medium. Specifically, the present invention relates to the closure mechanism of an identification wristband that includes a closure mechanism receiving aperture that presents a continuous surface for receiving an indicia forming material thereon, i.e., printable ink. In addition, the present invention relates to an identification wristband that includes a dual closure mechanism, i.e., a single wristband is configured for being closed by either a snap closure or an adhesive closure.

Identification bands such as wristbands, bracelets or other closed-loop identification devices are generally known in the art. These bands carry some form of information or identification concerning an object. Wristbands typically comprise an elongated flexible strap formed from flexible plastic or the like. For positive patient identification, the wristband is wrapped about the wrist of an authorized wearer and commonly includes engaging interfitting or interengageable securement members at opposite ends of the wristband. Thereafter, the interconnected wristband is retained around the wearer's wrist to identify the wearer.

Such wristbands are also commonly provided with a plurality of labels or tags. The combination wristband, labels, and tags are often printed on the same sheet stock. Labels are securable to the band or other surfaces via an adhesive and the tags may be adapted for slide-fit mounting into a pocket or a strap portion of the wristband. A common use for such an identification wristband, label and tag is in a medical facility setting. For example, the wristband is used for personal identification and/or access control at secured facilities. Other applications include military or industrial installations, prisons and the like.

In recent years, improved identification systems include identification bands and tags designed to incorporate wearer-related data in machine readable form. Machine readable form is preferred over traditional human readable data. Human readable data is typically limited in space and to the clarity of handwritten alphanumeric characters. Machine readable data may be stored utilizing a variety of technologies, including barcode or radio frequency identification (RFID) chips. Accordingly, data is conveniently accessed by scanning the barcode with a conventional reader or receiving radio signals emitted by an RFID chip. Machine readable data is also preferable over human readable data as electronic circuits are capable of storing more data on the wristband. Machine readable data technologies permit substantial increases in the volume and scope of wearer-related data carried by the identification band. Comparable conventional prior art bands bearing information only in human readable form are limited to the applicable printable space on the band.

Current identification bands bearing or carrying wearer-related information in human readable or machine readable form are typically constructed from a relatively stiff plastic-based material. These wristbands are designed to provide sturdy and durable substrates suitable for permanent imprinting of information thereon. Plastic-based wristbands also effectively support and protect RFID circuitry and other electronic devices disposed therein. Barcodes are also protectable by an outer clear plastic layer or laminate. Unfortunately, such plastic-based wristbands can exhibit relatively abrasive or sharp edges. Hence, the wristbands tend to be uncomfortable to wear over extended time periods.

Such prior art wristbands typically use mechanical closure mechanisms, i.e., clips with posts or other portions that pass through openings in the wristband. Such openings may interrupt or limit the available printable surface on the wristband. In addition, such openings produce waste material, i.e., chads, that may remain in the wristband and fall out during printing, resulting in a clogged printing device.

Some wristband designs known in the art also include an adhesive closure mechanism integrated with the laminating feature that protects the printed information thereon. Such adhesive closure mechanisms allow the end user to handle a single wristband component. End users need not worry about additional attachments or other securement devices. Additionally, there is limited space for barcodes and often these barcodes are difficult to scan. After the wristband is printed and laminated, any significant curvature therein causes barcode puckering. Puckering tends to lead to a leak path wherein moisture enters the interior of the wristband and causes bleeding or smudging of the barcode or other printed information thereon. Additionally, limiting wristband designs to an adhesive closure limits the number of materials that can be utilized. For example, only materials that react to or adhere to a pressure sensitive adhesive are usable with such a wristband. In turn, band durability and longevity is compromised by appropriate material selection. In some cases, these wristbands may only last up to three days.

Accordingly, there is a need for identification media having a closure mechanism that does not require voids or openings in the media and provides both an adhesive closure and snap-closure mechanism. Such identification media should include an identification area that is not interrupted by voids or openings. The present invention fulfills these needs and provides further related advantages.

SUMMARY OF THE INVENTION

The present invention comprises a flexible medium having a closure mechanism and adapted for receiving an indicia forming material thereon. The medium includes a flexible substrate having a printable surface for receiving the indicia forming material. The closure mechanism includes a closure mechanism receiving aperture coinciding with the printable surface and presenting a substantially contiguous planar surface which prevents passage of the indicia forming material when applied to the printable surface. The closure mechanism receiving aperture includes an arcuate cut and a post-slit proximate thereto. The post-slit permits passage of a post or similar structure on a closure mechanism.

In a preferred embodiment, the flexible substrate comprises an elongated wristband having first and second ends. A closure mechanism receiving aperture is disposed proximate to both the first and second ends of the wristband. The second end preferably includes a plurality of longitudinally spaced closure mechanism receiving apertures.

The post-slit is oriented generally longitudinally along the wristband and generally perpendicular to the arcuate cut. In an alternate configuration, the post-slit comprises a V-shaped cut generally centered on a radius of the arcuate cut. The post-slit may also comprises an X-shaped cut generally centered on a radius of the arcuate cut. The arcuate cut may comprise a plurality of arcuate cuts with the post-slit comprising an X-shaped cut generally centered on a radius of the arcuate cuts such that one of the plurality of arcuate cuts is positioned at an end of each arm of the X-shaped cut.

In addition, the present invention is directed to an identification wristband having dual-closure mechanisms. The wristband comprises an elongated strap having first and second ends, the wristband including both a snap closure and an adhesive closure. Each closure mechanism are configured to separately secure the first end of the strap to the second end of the strap.

The snap closure mechanism includes a securing aperture proximate to the first end of the strap, a plurality of sizing apertures proximate to the second end of the strap, and a mechanical retainer for engaging the securing aperture and one of the sizing apertures. The adhesive closure mechanism comprises a removable tab covering a pressure sensitive adhesive proximate to the first end of the strap, wherein removal of the tab exposes the pressure sensitive adhesive for attachment to the second end of the strap. The elongated strap may comprise a liner layer adhered to a media layer with the removable tab comprising a portion of the liner layer having a release layer thereunder. The securing aperture extends through the removable tab, the pressure sensitive adhesive and the media layer. The removable tab of the adhesive closure remains in place when the snap closure is utilized.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
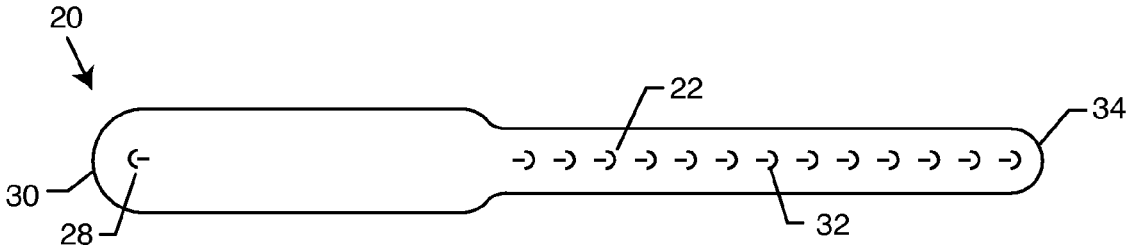
FIG. 1 is a top view of an identification wristband incorporating the closure mechanism receiving aperture of the present invention.
Figure 2:
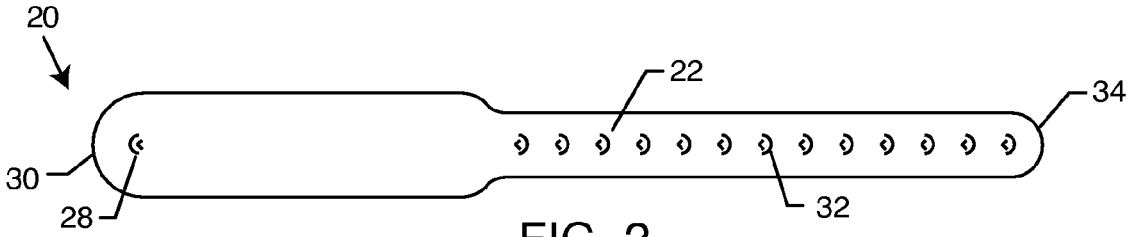
FIG. 2 is a top view of an identification wristband incorporating an alternate embodiment of the closure mechanism receiving aperture of the present invention.
Figure 3:
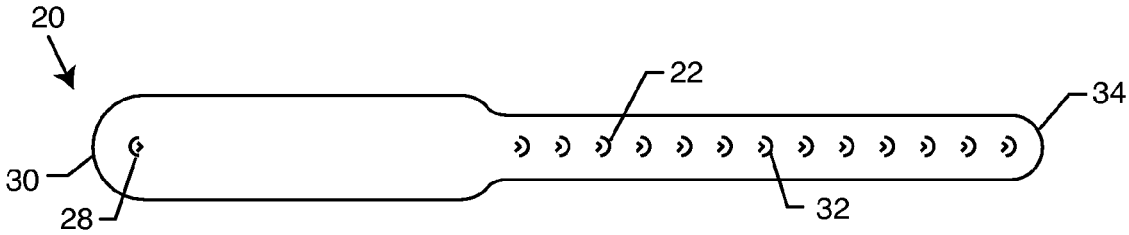
FIG. 3 is a top view of an identification wristband incorporating another alternate embodiment of the closure mechanism receiving aperture of the present invention.
Figure 4:
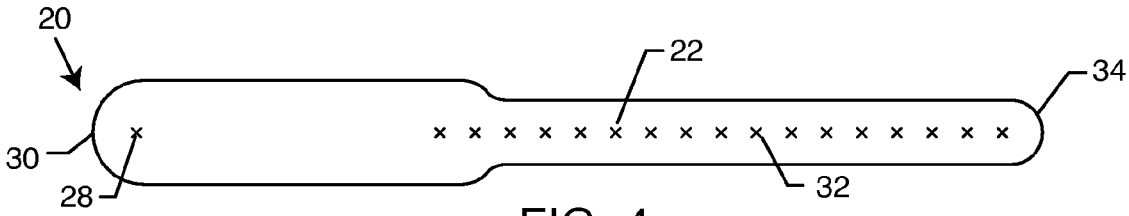
FIG. 4 is a top view an identification wristband incorporating yet another alternate embodiment of the closure mechanism receiving aperture of the present invention.

As shown in the drawings for purposes of illustration, a printable wristband embodying the present invention is referred to generally by the reference number 20. FIGS. 1 through 4 illustrate the wristband 20 including various embodiments of the closure mechanism receiving apertures 22. FIGS. 5 through 8 illustrate close-ups of various embodiments of the closure mechanism receiving apertures 22.

The apertures 22 are not holes, but rather a series of cuts or piercings through the wristband 20 material. With this method of creating an aperture 22 there is no waste material as existed in prior art apertures. This is very advantageous in that the waste material does not have to be vacuumed out at the time of manufacture. Machines that produce prior art apertures generate waste material when manufacturing punch holes. Such waste material has to be vacuumed out to a vacuum chamber beside the machine. These vacuum chambers can get easily clogged and many times the waste material is left in the prior art aperture which can then foul up a printer through which the prior art aperture and waste material is passed. In laser printers, such waste material is heated and can get stuck to the print drum, thus ruining it.

Figure 5:
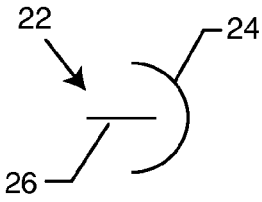
FIG. 5 is a close-up view of a closure mechanism receiving aperture of the present invention.

FIGS. 1 and 5 illustrate the preferred embodiment of the closure mechanism receiving aperture 22. In this preferred embodiment, the aperture 22 includes a scallop or arcuate cut 24 and a post slit 26. The arcuate cut 24 should be oriented such that the convex side points toward the ends of the wristband 20. The configuration of the arcuate cut 24 prevents tearing of the wristband 20 material along the cuts of the apertures 22 due to the stress of pulling on a wristband 20.

Described another way, the arcuate cut 24 should be oriented such that the convex side points in the anticipated direction of stress. In wristbands 20 with snap closure mechanisms (described below), the direction of stress is toward the ends of the wristband 20. When the wristband is secured in a closed loop about a person or object, a post passes through the post slits 26 of paired apertures 22 and any tension on the wristband 20 will cause the ends to be pulled apart. This pulling apart of the ends of the wristband 20 will create stress directed toward the ends of the wristband 20.

Figure 6:
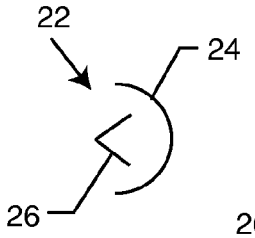
FIG. 6 is a close-up view of an alternate closure mechanism receiving aperture of the present invention.
Figure 7:
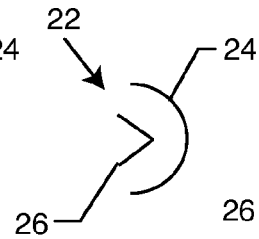
FIG. 7 is a close-up view of another alternate closure mechanism receiving aperture of the present invention.
Figure 8:
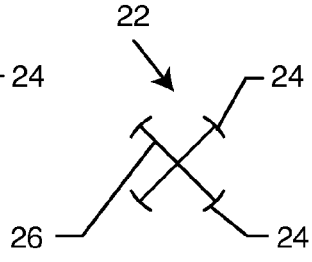
FIG. 8 is a close-up view of yet another alternate closure mechanism receiving aperture of the present invention.

The post slit 26 is preferably a single cut oriented generally perpendicular to the arcuate cut 24 as illustrated in FIG. 5. The post slit 26 should be oriented so that a force vector resulting from longitudinal stress on the wristband 20 at the aperture 22 is directed generally transverse to the arcuate cut 24. Alternatively, the post slit 26 may comprise a V-shaped cut as illustrated in FIGS. 6 and 7 or an X-shaped cut as illustrated in FIG. 8. The V-shaped post slits 26 may be oriented with the point of the V directed toward the arcuate cut 24 or away from the arcuate cut 24. When the post slit 26 comprises an X-shaped cut, the arcuate cut 24 is preferably segmented into a plurality of arcuate cuts 24, with an arcuate cut 24 placed at the end of each arm of the X-shaped cut.

The shape of the aperture 22 is unique in its performance because the arcuate cut 24 forms a radius or arc of a circle similar to that portion of a corresponding hole had it been punched out. A post slit 26 in the form of a single cut, a V-shaped cut or an X-shaped cut without the arcuate cut 24 would not form a circle pattern. When a post is inserted into a non-circular pattern, the pattern has a tendency to continue to tear along the corners, apexes, or in the case of an X-shaped cut, along the arms of the X-shape. The inventive aperture 22 with the arcuate cut 24 terminates any tears and tends toward a circular shape when pulled or stressed. The arcuate cut 24 creates a stronger, more stable aperture 22 when compared to a post slit 26 without an arcuate cut 24.

If a post from a closure mechanism (described below) is placed through the post slit 26, stress on the wristband 20 may cause the material to tear along the cut of the post slit 26. The configuration of the arcuate cut 24 and the post slit 26 will cause any tearing to run in the direction of the post slit 26 and intersect the arcuate cut 24. When the tearing intersects the arcuate cut 24, the tearing will be stopped and the wristband 20 will not completely tear away unless excessive force is applied.

As illustrated in FIGS. 1 through 4, the apertures 22 are positioned along the wristband 20 such that a securing aperture 28 is positioned at a first end 30 and a plurality of sizing apertures 32 are positioned near to a second end 34. The FIGURES illustrate separate wristbands 20 having a single type of aperture 22 on each. However, the types of aperture 22 used on a particular wristband 20 may be mixed as desired, i.e., single cut with V-shaped cut, or V-shaped cut with X-shaped cut, etc. Regardless of the type of aperture 22 used, the same tear resistant qualities will be achieved.

The apertures 22 of the present invention provide a substantially contiguous, uninterrupted (i.e., no holes or punch-outs) planar surface on the wristband 20. This contiguous, uninterrupted surface increases the available printable surface on the wristband 20. The pattern of the inventive aperture 22 is easily printed over using thermal or laser printers. When prior art holes are punched, neither type of printer can print on the opening of the hole. The prior art hole interrupts the available print area. In prior art wristbands that included holes or punch-outs, printers were not able to print over the prior art apertures because the ink (or indicia forming material) would pass through the holes. In addition, the punch-outs, if left in the wristband after manufacture may fall out during printing or other processing and create a blockage or other damage in machines processing the prior art wristband.

The inventive apertures 22 eliminate these problems by presenting an uninterrupted surface and eliminating punch-outs. The inventive aperture 22 provides a substantially contiguous, uninterrupted planar surface which can be printed over by a printer without interruption of the printed image or information. For example, in the case of barcodes with sufficient redundancy, the barcodes can easily be read when printed over the apertures 22 described herein. In addition, tooling for such apertures 22 is easier to construct and machine because it follows the shape of a circle and does not require removal of waste material.

Figure 9:
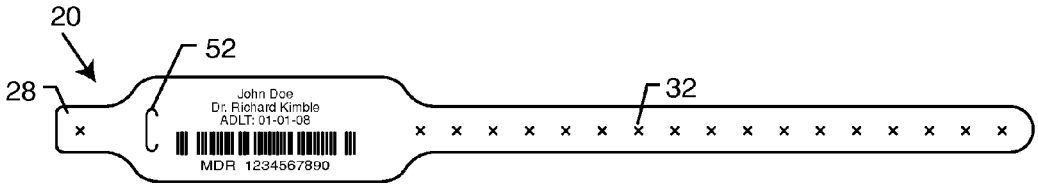
FIG. 9 is a top view of an identification wristband illustrating the dual closure feature of the present invention.
Figure 10:
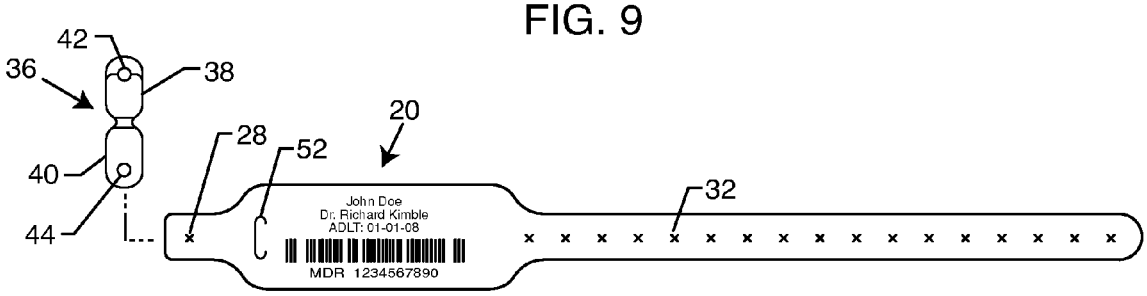
FIG. 10 is a top view of an identification wristband illustrating the snap closure mechanism of the present invention.
Figure 11:
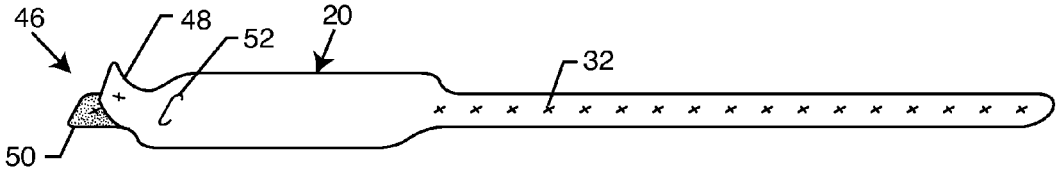
FIG. 11 is a bottom view of an identification wristband illustrating the adhesive closure mechanism of the present invention.

FIGS. 9 through 11 illustrate a further embodiment of the present invention wherein the wristband 20 includes the inventive apertures 22, as well as dual closure mechanisms, i.e., a snap closure and an adhesive closure. As illustrated in FIG. 10, a snap closure 36 is provided for use with the securing aperture 28 and the sizing apertures 32. The snap closure 36 comprises a clam-shell type device with upper 38 and lower 40 halves, a stem 42 on the upper half 38 and a receiving or mating opening 44 on the lower half 40.

Figure 12:
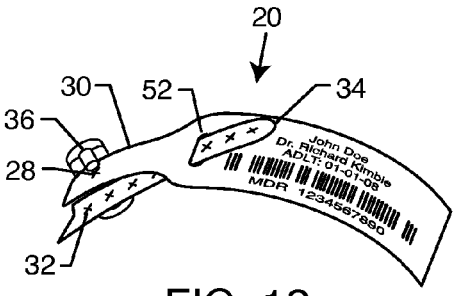
FIG. 12 is a perspective view illustrating the application of the snap closure mechanism of the present invention.

The operation of the snap closure 36 is illustrated in FIG. 12. To use the snap closure 36, the stem 42 is pushed through the securing aperture 28 and an aligned sizing aperture 32 selected according to the circumference of the wrist of the person to be identified. The upper 28 and lower 40 halves of the snap closure 36 are then brought together so that the stem 42 engages the mating opening 44. These types of snap closure mechanisms are known in the art. As described, insertion of the stem 42 through the apertures 22 does not punch a hole or otherwise disengage a "chad", it merely passes through the post slit 26. Eliminating "chads" eliminates the possibility that such material may fall out and jam a printer.

Figure 13:
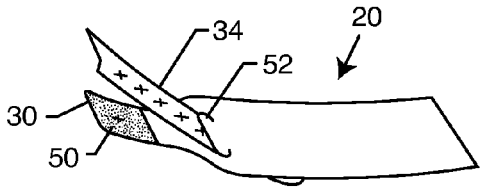
FIG. 13 is a perspective view from underneath illustrating the application of the adhesive closure mechanism of the present invention.

The same wristband 20 is also provided with an adhesive closure 46, as shown in FIG. 11. The adhesive closure 46 includes a removable tab 48 which covers an adhesive layer 50. The operation of the adhesive closure 46 is illustrated in FIG. 13. When the removable tab 48 is removed, the adhesive layer 50 is exposed. The second end 34 of the wristband 20 is then looped around and adhered to the adhesive layer 50 to close the loop. The size of the loop can be adjusted according to the circumference of the wrist of the person to be identified by varying the point proximate the second end to which the adhesive layer 50 is adhered. When the adhesive closure 46 is utilized the apertures 22 are not utilized, unless the snap closure 36 and adhesive closure 46 are utilized at the same time.

As generally shown in FIGS. 9-11, the first end 30 of the wristband 20 is configured with the securing aperture 28 for the snap closure 36, as well as, the removable tab 48 and adhesive layer 50 of the adhesive closure 46. The second end 34 of the wristband 20 includes the sizing apertures 32 of the snap closure 36, as well as, the available surface of the wristband to be adhered to the adhesive layer 50 of the adhesive closure 46.

As shown in FIGS. 9 through 13, the wristband 20 also includes an alignment slot 52 near to the first end 30 of the wristband 20. The alignment slot 52 provides additional support to the second end 34 of the wristband 20 so that it will remain in line with the first end 30. As shown in FIGS. 12 and 13, the second end 34 of the wristband 20 is passed through the alignment slot 52 prior to securing either the snap closure 36 or the adhesive closure 46. The alignment slot 52 prevents the second end 34 from twisting, particularly around the post 42 of the snap closure 36. If the second end 34 were permitted to twist, the wristband could become uncomfortable for the wearer. Further, if the second end 34 is permitted to twist, then stress forces on the wristband 20 may be oriented in a direction other than toward the end of the wristband 20 and the apertures 22 may not function as designed.

A wristband 20 is preferably manufactured using a combination of the snap closure 36 and the adhesive closure 46. Hence, only one layout is needed to accommodate both closures of the present invention and requires only one tool die to form the wristband 20. This streamlines manufacturing and eliminates the need for multiple tool dies. Production costs for additional tool dies are therefore alleviated. Moreover, customers have the option of using either the snap closure 36 or the adhesive closure 46 with the same wristband 20. It is possible to switch from the snap closure 36 to the adhesive closure 46 without changing the form factor of the wristband 20.

The design of the apertures 22 also facilitates the production of one style of wristband compatible with both the snap closure 36 and the adhesive closure 46. Eliminating holes along the wristband 20 improves adherence of the adhesive layer 50 of the first end 30 to the second end 34 when the wristband 20 is used with the adhesive closure 46. Holes in the wristband 20 not only reduce the amount of printable area, but also remove additional contact area with the adhesive layer 50 and expose the adhesive layer 50 to the skin of the person identified. Adhesion of the wristband 20 to the skin of a wristband wearer creates discomfort for the wearer.

Although several embodiments have been described in detail for purposes of illustration, various modifications may be made without departing from the scope and spirit of the invention. Accordingly, the invention is not to be limited, except as by the appended claims.

What is claimed is:

1. A flexible medium having a closure mechanism and adapted for receiving an indicia forming material thereon, comprising:

a flexible substrate including a printable surface for receiving the indicia forming material; and a closure mechanism receiving aperture presenting a substantially contiguous planar surface which prevents passage of the indicia forming material when applied to the printable surface and yet permits passage of a closure mechanism, the closure mechanism receiving aperture including an arcuate cut and a post-slit proximate thereto.

2. The flexible medium of claim 1, wherein the flexible substrate comprises an elongated wristband having first and second ends, and a closure mechanism receiving aperture disposed proximate to both the first and second ends.

3. The flexible medium of claim 2, wherein the second end includes a plurality of longitudinally spaced closure mechanism receiving apertures.

4. The flexible medium of claim 2, wherein the post-slit is oriented generally longitudinally along the wristband and generally perpendicular to the arcuate cut.

5. The flexible medium of claim 1, wherein the post-slit comprises a V-shaped cut generally centered on a radius of the arcuate cut.

6. The flexible medium of claim 1, wherein the post-slit comprises an X-shaped cut generally centered on a radius of the arcuate cut.

7. The flexible medium of claim 1, wherein the arcuate cut comprises a plurality of arcuate cuts.

8. The flexible medium of claim 7, wherein the post-slit comprises an X-shaped cut generally centered on a radius of the arcuate cuts such that one of the plurality of arcuate cuts is positioned at an end of each arm of the X-shaped cut.

9. An identification device having a closure mechanism and adapted for receiving an indicia forming material thereon, comprising:

a substrate comprising a flexible medium and a closure mechanism receiving aperture, the closure mechanism receiving aperture including an arcuate cut and a post-slit proximate thereto; and a printable surface on the substrate, at least a portion of which coincides with the closure mechanism receiving aperture, the closure mechanism receiving aperture presenting a substantially contiguous planar surface which prevents passage of the indicia forming material when applied to the printable surface and yet permits passage of a closure mechanism.

10. The identification device of claim 9, wherein the flexible substrate comprises an elongated wristband having first and second ends, and a closure mechanism receiving aperture disposed proximate to both the first and second ends.

11. The identification device of claim 10, wherein the second end includes a plurality of longitudinally spaced closure mechanism receiving apertures.

12. The identification device of claim 10, wherein the post-slit is oriented generally longitudinally along the wristband and generally perpendicular to the arcuate cut.

13. The identification device of claim 9, wherein the post-slit comprises a V-shaped cut generally centered on a radius of the arcuate cut.

14. The identification device of claim 9, wherein the post-slit comprises an X-shaped cut generally centered on a radius of the arcuate cut.

15. The identification device of claim 14, wherein the arcuate cut comprises a plurality of arcuate cuts.

16. The identification device of claim 15, wherein the post-slit comprises an X-shaped cut generally centered on a radius of the arcuate cuts such that one of the plurality of arcuate cuts is positioned at an end of each arm of the X-shaped cut.

17. A closure mechanism receiving aperture for a flexible printable medium for attaching the medium to a person or object, comprising:

an arcuate cut and a post-slit proximate thereto, wherein the post-slit comprises a first V-shaped cut generally centered on a radius of the arcuate cut and wherein the closure mechanism receiving aperture presents a substantially contiguous planar surface which prevents passage of the indicia forming material when applied to the printable medium and yet permits passage of a closure mechanism.

18. The closure mechanism receiving aperture of claim 17, wherein the flexible printable medium comprises a wristband and wherein the post-slit is oriented generally longitudinally along the wristband and generally perpendicularly to the arcuate cut.

19. The closure mechanism receiving aperture of claim 17, wherein the arcuate cut comprises a plurality of arcuate cuts, such arcuate cuts generally bisected by the arms of the first V-shaped cut.

20. The closure mechanism receiving aperture of claim 17, wherein the post-slit further comprises a second V-shaped cut wherein said first V-shaped cut and second V-shaped cut are disposed relative to each other to form an X-shaped cut generally centered on a radius of the arcuate cut.

21. The closure mechanism receiving aperture of claim 20, wherein the arcuate cut comprises a plurality of arcuate cuts, each of said arcuate cuts generally bisected by an arm of the X-shaped cut.

* * * * *